United States Patent [19]

Wilden

[11] 4,247,264

[45] Jan. 27, 1981

[54] AIR DRIVEN DIAPHRAGM PUMP

[75] Inventor: James K. Wilden, Yucaipa, Calif.

[73] Assignee: Wilden Pump & Engineering Co., Colton, Calif.

[21] Appl. No.: 29,619

[22] Filed: Apr. 13, 1979

[51] Int. Cl.[3] ..... F04B 17/00; F04B 43/06; F04B 21/02

[52] U.S. Cl. ..... 417/393; 417/395; 417/454; 417/536; 92/98 R; 92/128

[58] Field of Search ..... 417/393, 395, 397, 454, 417/535, 536, 537, 236, 237; 418/70; 92/128, 98 R

[56] References Cited

U.S. PATENT DOCUMENTS

| | | | |
|---|---|---|---|
| 2,415,060 | 1/1947 | Craig | 92/128 X |
| 2,625,886 | 1/1953 | Browne | 417/393 X |
| 3,039,399 | 6/1962 | Everett | 417/536 |
| 3,236,188 | 2/1966 | Eves et al. | 92/128 X |
| 3,776,667 | 12/1973 | Berglund | 417/454 |
| 3,849,033 | 11/1974 | Schall | 417/454 |
| 4,008,012 | 2/1977 | Page | 417/454 |

FOREIGN PATENT DOCUMENTS

| | | | |
|---|---|---|---|
| 11068 | of 1911 | United Kingdom | 417/536 |

*Primary Examiner*—Leonard E. Smith
*Attorney, Agent, or Firm*—Lyon & Lyon

[57] ABSTRACT

A pump assembly for an air driven diaphragm pump mechanism having opposed pump cavities with the actuator valve mechanism located between these cavities. An inlet manifold and an outlet manifold each extend to both of the opposed pump cavities and are positioned diametrically on the pump. Tie rods extend betweeen the manifolds to draw the manifolds toward one another about the pump housing.The mating surfaces between the manifolds and the pump chamber housings are such that drawing the manifolds toward one another causes a compression in the pump components such that the entire pump may be held together by the tie rods alone.

7 Claims, 2 Drawing Figures

AIR DRIVEN DIAPHRAGM PUMP

BACKGROUND OF THE INVENTION

The present invention is directed to air driven diaphragm pumps and is more specifically directed to the assemblies of such pumps.

Air driven diaphragm pumps have found great utility in construction and industrial uses. The durable and reliable nature of these devices along with their ability to handle a wide variety of substances have made these pumps mandatory equipment in many applications. In many construction and maintenance operations, the portability of these devices is also a major advantage.

In pumps of this nature, the least durable part of the pump is most often the diaphragm or diaphragms used to alternately expand and contract the pumping chamber. Such diaphragms are expected to survive a high number of flexure cycles and a significant amount of abrasion due to the environment in which they are to operate. These conditions have been found to result in the diaphragms becoming the most frequently replaced components in such pumps.

In spite of the need to periodically replace diaphragms in such devices, the diaphragms are located by necessity in positions where the major portion of the pump must be disassembled to effect their replacement. The outer pump cavity housings must naturally be removed. Furthermore, the inlet and outlet manifolding associated with those outer housings also must be detached. Heretofore, clamp bands have been employed to hold the diaphragm chamber housings together; and separate attachment mechanisms have been used to secure the manifolds. To provide repeated easy access to the diaphragm, a substantial number of bolts, clamp bands and associated fasteners have been required. Naturally, with each additional component, the pump gains in weight, cost and complexity. At the same time, the difficulty of disassembly and reassembly increases and the possibility of error becomes greater. Thus, it has long been a goal of the pump manufacturers to reduce the number of components and potential trouble spots associated with such pumps.

The foregoing difficulty is greatly aggravated in certain industries and uses where frequent dismantling is required. In brewing, all system components handling yeast or mixtures containing yeast, including pumps, must be broken down daily for cleaning. In pumping certain substances, it may also be necessary to frequently clean the pump chambers to prevent product build up and the like. Therefore, there are many situations where the pumps must be disassembled far more frequently than would be required to replace a diaphragm which has failed. Naturally, the possibilities for error are greatly increased with such frequent dismantling.

SUMMARY OF THE INVENTION

The present invention is directed to a new assembly for air driven diagphragm pumps. The basic pump configuration has been retained with a central actuator valve, opposed pump cavities with inner and outer pump chamber housings and diametrically positioned inlet and outlet manifolds which extend to each of the opposed pump cavities. The present invention has avoided the use of clamp bands for holding the housings together around the positioned diaphragms and the fasteners required to attach the inlet and outlet manifolds to the pump body. Instead, mechanisms are employed to forcibly draw the manifolds toward one another while the mating surfaces between the manifolds and the pump chamber housings are at angles such that the drawing force on the manifolds acts to compress the total assembly together. In this way, simple tie rods between the manifolds act to hold all of the pump components in place. Thus weight, complexity and the chance of errors in disassembly and reassembly all are reduced. All of these effects are very advantageous to the utility of such devices.

To further improve the utility of the assembly mechanism, the tie rods include hand tightened nuts and carriage bolt heads positioned in slots in the diametrically opposed manifolds. Because of the O-ring type structure of the sealing rim of the diagphragms, it is not necessary to create heavy sealing pressures. As pumping pressures within the pump cavities increase, the rims of the diaphragms are forced into greater sealing engagement with the pump housing. Consequently, hand tightening has been found to be sufficient. The slotted nature of the manifold attachments makes total unthreading unnecessary for disassembly. The carriage bolt heads in association with the slots make holding of the head unnecessary during assembly with the hand tigntened nuts.

Accordingly, it is an object of the present invention to provide an improved structure for an air driven diaphragm pump.

It is another object of the present invention to provide an easily assembled air driven diaphragm pump.

Further objects and advantages will appear hereinafter.

DETAILED DESCRIPTION OF THE PREFERRED EMBODIMENT

Figure 1:
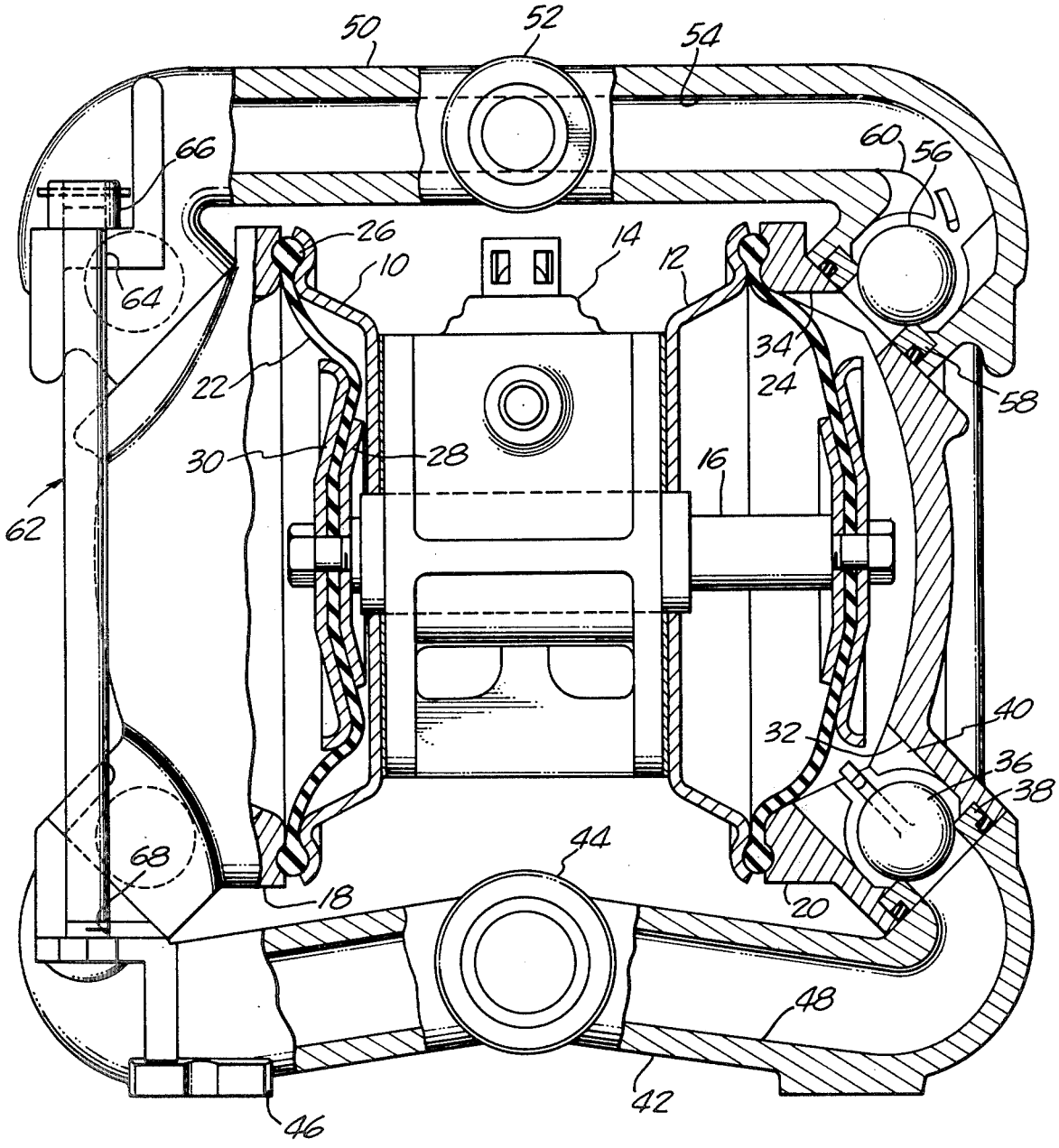
FIG. 1 is an elevation of a pump of the present invention with portions cut away for clarity.

Turning in detail to the drawings, an air driven diaphragm pump is illustrated. The pump includes a central pump drive assembly consisting of two drive chamber housings 10 and 12 and an actuator valve 14 positioned between the drive chamber housings 10 and 12. Extending from the actuator valve 14 through the drive chamber housings 10 and 12 is a control rod 16. Compressed air is alternately introduced to either side of the pump drive assembly through the actuator valve 14 as determined by the position of the control rod 16. The operation of the actuator valve is disclosed in U.S. Pat. No. 3,017,118, the disclosure of which is incorporated herein by reference.

The drive chamber housings 10 and 12 are associated with pump chamber housings 18 and 20 to form opposed pump cavities. These cavities are most conveniently circular and are of sufficient depth to accommodate the full stroke of the pump. Located within the opposed pump cavities are diaphragms 22 and 24. The diaphragms 22 and 24 divide each of the opposed pump cavities into an air chamber and a pump chamber. The diaphragms 22 and 24 have a circular bead about the periphery of the diaphragm. Each bead 26 is positioned in two channels, one in the drive chamber housings 10 and 12 and one in the pump chamber housings 18 and 20. The bead acts to seal the chambers and to locate the housings relative to one another. Located about the center of each of the diaphragms 22 and 24 are piston assemblies associated with the control rod 16. These piston assemblies include an inner plate 28 and an outer plate 30 which sandwich the diaphragms therebetween. The combination of the piston assemblies and the control rod 16 maintain the alignment of the diaphragm, contribute to uniform flexure and provide a feedback input to the actuator valve 14.

The pump chamber housings 18 and 20 define the outer walls of the opposed pump cavities forming pump chambers with the diaphragms 22 and 24. Each pump chamber housing 18 and 20 includes an inlet port 32 and an outlet port 34. The inlet port 32 is located at the lower end of the pump chamber housing and includes a ball check valve located within the inlet port 32. The ball check valve includes a ball 36, a seat 38 and ribs 40. The ribs 40 simply act to retain the ball 36 in the ball check valve. The seat 38 is conveniently positioned at the outer end of the inlet port 32 so that it can be easily replaced if necessary. The inlet port 32 terminates in a surface which is in a plane at roughly a 45° angle to the axis of the control rod 16. The outlet port 34 is simply a hole through the wall of the pump chamber housings 18 and 20 which terminates in a surface which is also at an angle relative to the control rod 16 of approximately 45 degrees.

The inlet manifold 42 extends from a central inlet position 44 outwardly to the inlet ports 32 associated with each pump chamber housing 18 and 20. The inlet manifold 42 conveniently inlcudes feet 46 in order that the pump will stand independently. An inlet passageway 48 extends from the inlet 44 to each of the inlet ports 32 such that a mating surface is provided adjacent each of the inlet ports 32 which will meet the surface extending at 45° relative to the control rod 16, the inlet manifold 42 being outwardly of the inlet ports 32. A valve seat 38 is positioned at the surface of each of the inlet ports 32 to hold the seat 38 in place by placement of the inlet manifold 42 as can best be seen in FIG. 1.

An outlet manifold 50 is positioned above the main part of the pump and is diametrically opposed to the inlet manifold 42. The outlet manifold 50 also includes a central port 52 and a passageway 54 extending to each of the pump chamber housings 18 and 20. The outlet manifold 50 includes outlet port ball check valves each including a ball 56, a seat 58 and placement ribs 60. The ball check valve is placed in the outlet manifold rather than in the pump chamber housings 18 and 20 such that the seat 58 may be at the joint between the pump chamber housings 18 and 20 and the outlet manifold 50 as can best be seen in FIG. 1. The surface of each of the pump chamber housings 18 and 20 mating with the outlet manifold 50 is angled, as mentioned above, at 45°. The mating surfaces of the outlet manifold 50 are similarly angled such that the outlet manifold is outwardly of the pump chamber housings 18 and 20.

Figure 2:
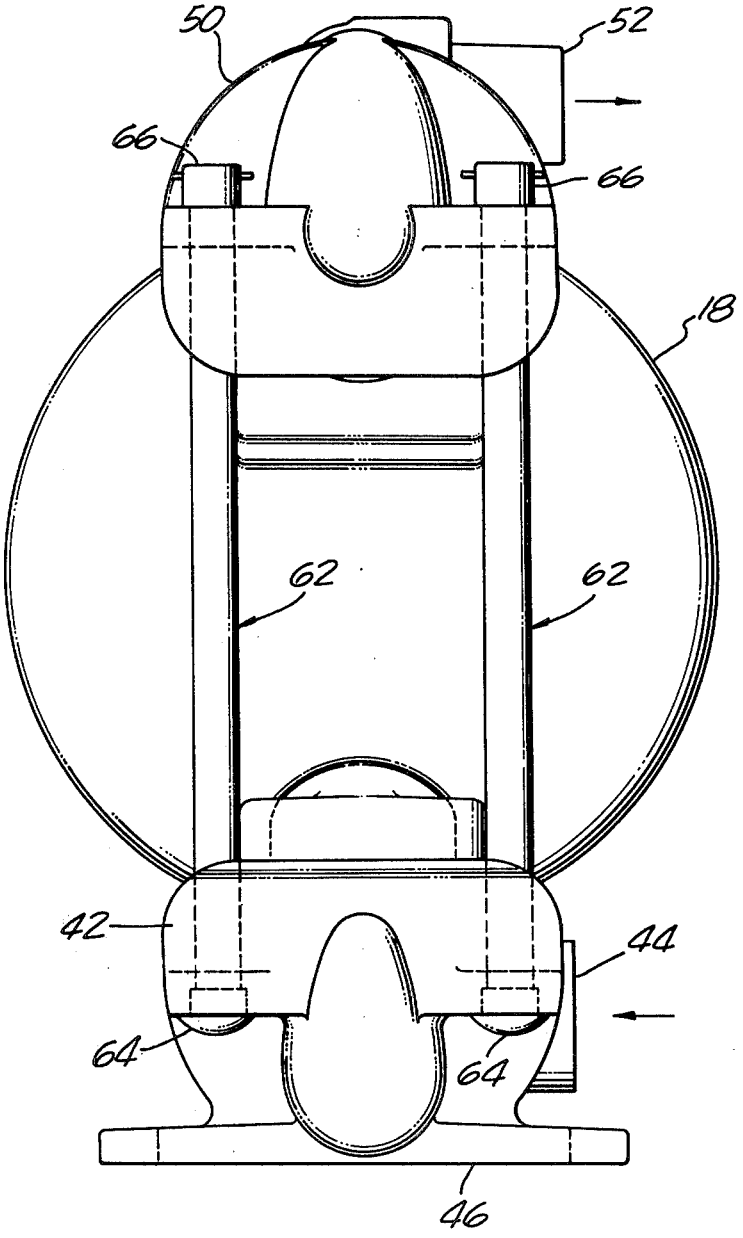
FIG. 2 is a side view of a pump of the present invention.

To tie the pump assembly together, tie rods 62 extend between the inlet manifold 42 and the outlet manifold 50. As can be seen in FIG. 2, a paif of tie rods are positioned at one end of the pump. As can be seen in FIG. 1, a second pair of tie rods 62 is positioned at the other end of the pump as well. In the present embodiment, the tie rods 62 include carriage bolts 64 threaded at one end to receive hand tightened nuts 66. These tie rods 62 act as means for forcibly drawing the inlet manifold 42 and the outlet manifold 50 together and provide a drawing line of foce along the rods. The manifolds 42 and 50 have open ended slots 68 for receiving the tie rods 62 without completely separating the nut 66 from the bolt 64.

As can be seen in FIG. 1, the mating surfaces between both manifolds and the pump chamber housings 18 and 20 are at acute angles relative to the direction of force imposed by the tie rods 62. As the tie rods are drawn together, the manifolds 42 and 50 are drawn together. This movement in turn forces the pump chamber housings 18 and 20 toward one another. Compression in the main body of the pump is then experienced to hold the diaphragms 22 and 24 between the drive chamber housings 10 and 12 and the pump chamber housings 18 and 20. The drive chamber housings 10 and 12 may also be retained in this compressed asembly against the actuator valve 14. In this way four tie rods 62 are capable of holding the entire pump assembly together. The angle of the mating surfaces to the tie rods is shown to be 45°. However, a 45° angle is not critical and may be increased or decreased depending on the amount of compression per unit of tension in the tie rods which may be desired.

Thus, an improved air driven diaphragm pump assembly is disclosed which is easy to assemble and which employs a minimum of parts. Consequently, diaphragms, check valves and the valve actuator may be changed very quickly with a minimum of down time and a minimum of potential assembly error. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A pump having opposed pump cavities, a pump drive assembly between said cavities forming an inner wall of each of said cavities, pump chamber housings meeting with said pump drive assembly to form the outer wall of each of said cavities, an inlet manifold extending to and in communication with each of said cavities and an outlet manifold extending to and in communication with each of said cavities, said inlet and outlet manifolds being diametrically opposed, wherein the improvement comprises means for forcibly drawing said manifolds towards one another;

said manifolds and said pump chamber housings including mating surfaces therebetween lying in planes at an acute angle to the line of force drawing said manifolds toward one another, said manifold mating surfaces each being outwardly of each associated pump chamber housing mating surface.

2. The pump of claim 1 wherein a diaphragm is positioned between said pump drive assembly and each said pump chamber housing to divide each said cavity into a drive chamber and a pump chamber, each said diaphragm being oriented in a plane parallel to the line of force drawing said manifolds toward one another and being compressed by drawing said manifolds toward one another.

3. The pump of claim 1 wherein said communication between each of said cavities and each of said manifolds is controlled by a ball check valve.

4. The pump of claim 1 wherein sad acute angle is approximately about 45°.

5. The pump of claim 1 wherein said means for forcibly drawing said manifolds toward one another include threaded fasteners.

6. An air driven diaphragm pump having opposed pump cavities comprising drive chamber housings forming the inner wall of each of the pump cavities;

pump chamber housings associated with said drive chamber housings to form the outer wall of each of the pump cavities;

diaphragms positioned between each of said pump chamber housings and said drive chamber housings to divide each pump cavity into a drive chamber and a pump chamber;

an actuator valve for alternately pressurizing and exhausting said drive chambers;

an inlet manifold extending to each of said pump chamber housings and being in communication with each said pump chamber;

an outlet manifold extending to each of said pump chamber housings and being in communication with each pump chamber, said inlet and outlet manifolds being diametrically opposed; and tie rods for forcibly drawing said manifolds toward one another, said manifolds and said pump chamber housings including mating surfaces therebetween lying in planes at approximately a 45° angle to the line of force drawing said manifolds toward one another and said manifold mating surfaces each being outwardly of each associated pump chamber housing mating surface.

7. The pump of claim 6 wherein said tie rods include hand tightened nuts and said manifolds include open ended slots to receive said tie rods.

* * * * *